US009910381B2

(12) United States Patent
Yamazaki et al.

(10) Patent No.: US 9,910,381 B2
(45) Date of Patent: Mar. 6, 2018

(54) IMAGE-FORMING APPARATUS

(75) Inventors: Ryuya Yamazaki, Nagoya (JP); Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 104 days.

(21) Appl. No.: 13/219,498

(22) Filed: Aug. 26, 2011

(65) Prior Publication Data

US 2012/0051800 A1 Mar. 1, 2012

(30) Foreign Application Priority Data

Aug. 31, 2010 (JP) ..... 2010-193384

(51) Int. Cl.
*G03G 15/08* (2006.01)
*G03G 15/01* (2006.01)

(52) U.S. Cl.
CPC ..... *G03G 15/0812* (2013.01); *G03G 15/0121* (2013.01); *G03G 15/0194* (2013.01)

(58) Field of Classification Search
CPC ..... G03G 15/0121; G03G 15/0812
USPC ..... 399/111, 119, 274, 284
See application file for complete search history.

(56) References Cited

U.S. PATENT DOCUMENTS

| | | | | |
|---|---|---|---|---|
| 7,542,705 | B2 | 6/2009 | Tsunemi et al. | |
| 7,693,447 | B2 | 4/2010 | Lee et al. | |
| 2003/0138270 | A1* | 7/2003 | Matsuoka | 399/228 |
| 2004/0085431 | A1* | 5/2004 | Asuwa et al. | 347/129 |
| 2004/0091290 | A1 | 5/2004 | Yamada et al. | |
| 2007/0147890 | A1* | 6/2007 | Hayakawa | 399/119 |
| 2007/0286639 | A1 | 12/2007 | Murayama | |
| 2009/0304412 | A1* | 12/2009 | Hattori et al. | 399/111 |

(Continued)

FOREIGN PATENT DOCUMENTS

| | | | |
|---|---|---|---|
| JP | 2002-207355 | A | 7/2002 |
| JP | 2004-206070 | A | 7/2004 |

(Continued)

OTHER PUBLICATIONS

Japan Patent Office, Notice of Reasons for Rejection for Japanese Patent Application No. 2010-193384 (counterpart Japanese patent application), dated Jun. 19, 2012.

(Continued)

*Primary Examiner* — Thomas Giampaolo, II
(74) *Attorney, Agent, or Firm* — Baker Botts L.L.P.

(57) ABSTRACT

An image-forming apparatus includes a first photosensitive member, a second photosensitive member, an exposure unit, a first developing unit and a second developing unit. The first developing unit includes a first developing roller, a first casing and a first thickness-regulating blade having a first base end and a first free end. The second developing unit includes a second developing roller, a second casing and a second thickness-regulating blade having a second base end and a second free end. The first thickness-regulating blade is disposed between the first developing roller and the exposure unit, or between the first developing roller and a first optical axis of the light to which the first photosensitive member is exposed. The first thickness-regulating blade extends from the first base end to the first free end in a following direction with respect to a moving direction of a peripheral surface of the first developing roller.

16 Claims, 6 Drawing Sheets

(56) References Cited

U.S. PATENT DOCUMENTS

| | | | | |
|---|---|---|---|---|
| 2010/0021200 | A1* | 1/2010 | Kato | G03G 21/1647 399/111 |
| 2010/0080616 | A1* | 4/2010 | Kamimura | 399/111 |
| 2010/0080624 | A1* | 4/2010 | Matsuda | 399/119 |
| 2010/0129111 | A1 | 5/2010 | Tamura | |

FOREIGN PATENT DOCUMENTS

| | | | |
|---|---|---|---|
| JP | 2006-257174 | A | 9/2006 |
| JP | 2007-059048 | A | 3/2007 |
| JP | 2007-134020 | A | 5/2007 |
| JP | 2007-328300 | A | 12/2007 |
| JP | 2009-265128 | A | 11/2009 |
| JP | 2010-128053 | A | 6/2010 |

OTHER PUBLICATIONS

State Intellectual Property Office of the People's Republic of China, The First Office Action for Chinese Patent Application No. 201110251974.3 (counterpart Chinese patent application), dated Jan. 14, 2013.

Japan Patent Office, Notification of Reasons for Rejection for Japanese Patent Application No. 2010-193384 (counterpart to above-captioned patent application), dated Apr. 30, 2013.

State Intellectual Property Office of the People's Republic of China, The Second Office Action for Chinese Patent Application No. 201110251974.3 (counterpart to above-captioned patent application), dated Aug. 15, 2013.

State Intellectual Property Office of the People's Republic of China, The Third Office Action for Chinese Patent Application No. 201110251974.3 (counterpart to above-captioned patent application), dated Feb. 7, 2014.

State Intellectual Property Office of the People's Republic of China, Decision of Rejection issued for Chinese Patent Application No. 201110251974.3 (foreign counterpart to above-captioned patent application), dated Jan. 7, 2015.

State Intellectual Property Office of the People's Republic of China, Notification of Reexamination issued for Chinese Patent Application No. 201110251974.3 (foreign counterpart of above-captioned patent application), dated Sep. 17, 2015.

State Intellectual Property Office of the People's Republic of China, Examination Decision of the Patent Reexamination Board issued for Chinese Patent Application No. 201110251974.3, dated Mar. 30, 2016.

* cited by examiner

IMAGE-FORMING APPARATUS

CROSS REFERENCE TO RELATED APPLICATION

The present application claims priority from Japanese Patent Application No. 2010-193384, which was filed on Aug. 31, 2010, the disclosure of which is incorporated herein by reference in its entirety.

BACKGROUND

1. Field of the Invention

The present invention relates to a tandem image-forming apparatus.

2. Description of the Related Art

A tandem image-forming apparatus in which thickness-regulating blades configured to regulate the thicknesses of toner layers by slidingly contacting with developing rollers are oriented substantially in the direction in which the photosensitive members are arranged is known.

In such a tandem image-forming apparatus, since the thickness-regulating blades are oriented substantially in the direction in which the photosensitive members are arranged, a predetermined size of the apparatus in the direction in which the photosensitive members are arranged is necessary for the thickness-regulating blades.

SUMMARY

A need has arisen to provide an image-forming apparatus which has a reduced size of the apparatus in the direction in which the photosensitive members are arranged.

According to an embodiment of the present invention, an image-forming apparatus includes a first photosensitive member, a second photosensitive member, an exposure unit, a first developing unit and a second developing unit. The second photosensitive member is disposed downstream the first photosensitive member. The exposure unit is configured to expose the first photosensitive member and the second photosensitive member to light. The first developing unit includes a first developing roller configured to supply, developer to the first photosensitive member, a first casing configured to support the first developing roller, and a first thickness-regulating blade having a first base end and a first free end. The first base end is secured to the first casing. The first free end regulates the thickness of the developer by slidingly contacting with the first developing roller. The second developing unit includes a second developing roller configured to supply the developer to the second photosensitive member, a second casing configured to support the second developing roller, and a second thickness-regulating blade having a second base end and a second free end. The second base end is secured to the second casing. The second free end regulates the thickness of the developer by slidingly contacting with the second developing roller. The first thickness-regulating blade, when seen in an axial direction of the first developing roller, is disposed between the first developing roller and the exposure unit, or between the first developing roller and a first optical axis of the light to which the first photosensitive member is exposed. The first thickness-regulating blade extends from the first base end to the first free end in a following direction with respect to a moving direction of a peripheral surface of the first developing roller.

DESCRIPTION OF THE PREFERRED EMBODIMENTS

An embodiment of the present invention will now be described in detail with reference to the accompanying drawings. The description proceeds in the following order: the overall configuration of a color LED printer 1 as an exemplary image-forming apparatus according to the embodiment, and features specific to the present invention.

In the following description, directions are defined with respect to the user who are using the color LED printer 1. Specifically, in FIG. 1, the left side is defined as the "front" side, the right side is defined as the "rear" side, the near side is defined as the "right" side, the far side is defined as the "left" side, and the vertical direction is defined as the "vertical" direction. In the embodiment, "the axial direction of a developing roller 62" corresponds to "the lateral direction", and "the direction in which developing units 60 are arranged" and "the direction in which photosensitive members (photosensitive drums 52) are arranged" correspond to "the anteroposterior direction".

[Overall Configuration of Color LED Printer]

Figure 1:
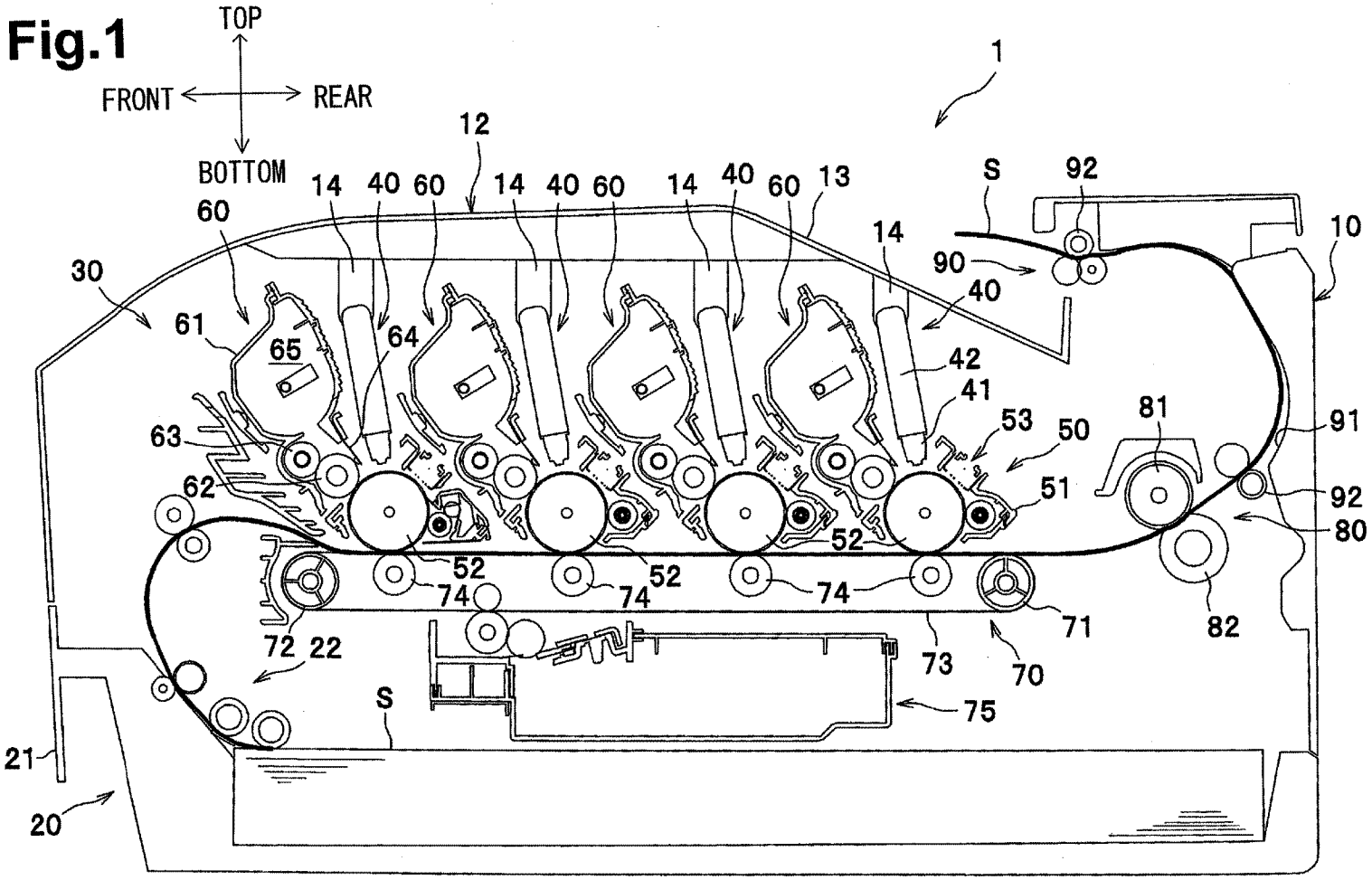
FIG. 1 shows the overall configuration of a color LED printer as an exemplary image-forming apparatus according to an embodiment of the present invention.

Referring to FIG. 1, the color LED printer 1 basically includes, in a main-body casing 10 thereof as an exemplary body of the apparatus, a sheet-feeding section 20 configured to feed a sheet S, an image-forming section 30 configured to form an image on the sheet S that is fed thereto, and a sheet-discharging section 90 configured to discharge the sheet S having the image.

The main-body casing 10 has at the top thereof an upper cover 12 vertically openable and closable about a fulcrum defined at a point at the rear. The top surface of the upper cover 12 forms a discharge tray 13 that receives the sheet S discharged from the main-body casing 10. The upper cover 12 is provided on the undersurface thereof with four holders 14. The holders 14 hold below-described LED units 40, respectively, such that the LED units 40 are swingable.

The sheet-feeding section 20 is provided at the bottom of the main-body casing 10 and basically includes a sheet tray 21 on which sheets S are stacked and a sheet-feeding mechanism 22 configured to feed each of the sheets S from the sheet tray 21 to the image-forming section 30. The sheets S in the sheet tray 21 are separated one by one and are each fed to the image-forming section 30 by the sheet-feeding mechanism 22.

The image-forming section 30 basically includes four LED units 40 as exemplary exposure units, four photosensitive member units 50, four developing units 60 consisting of, for example, C (Cyan), M (Magenta), Y (Yellow) and K (Black), a transfer unit 70, and a fixing unit 80.

The LED units 40 are positioned under the upper cover 12 and arranged in the anteroposterior direction. In a state where the upper cover 12 is closed, the LED units 40 face the respective photosensitive drums 52 from above. Basically, the LED units 40 each include a head 41 and a support 42 that supports the head 41.

The head 41 has at the tip thereof a plurality of light emitters (LEDs, not shown) lined up in the lateral direction. In the embodiment of the present invention, the light emitters lined up in the lateral direction may be either in a straight line or in a staggered line. Moreover, the light emitters may be provided either in one line or in two or more lines arranged in the anteroposterior direction.

The support 42 is attached to the upper cover 12 with a corresponding one of the holders 14 interposed therebetween.

The LED units 40 configured as above turn on and off the light emitters thereof in accordance with image data, thereby exposing the surfaces of the photosensitive drums 52 that have been charged to the light therefrom.

The photosensitive member units 50 are arranged in the anteroposterior direction between the upper cover 12 and the sheet-feeding section 20, and each basically include a photosensitive member case 51, a photosensitive drum 52 as an exemplary photosensitive member, and a charger 53. Although the photosensitive member units 50 according to the embodiment are fixed to the main-body casing 10, the present invention is not limited to such a configuration. The photosensitive member units 50 may be mountable into and demountable from the main-body casing 10.

The developing units 60 are arranged in the anteroposterior direction (the direction in which the photosensitive drums 52 are arranged) at a level substantially the same as the level where the LED units 40 are provided. The developing units 60 are mountable into and demountable from the main-body casing 10 in a state where the upper cover 12 is opened (see FIG. 3). The developing units 60 each basically include a casing 61, a developing roller 62, a supply roller 63, a thickness-regulating blade 64, and a toner-containing portion 65 (developer-containing portion) that contains a toner as an exemplary developer.

The transfer unit 70 is provided between the sheet-feeding section 20 and the photosensitive member units 50, and basically includes a driving roller 71, a follower roller 72, an endless conveying belt 73 stretched between the driving roller 71 and the follower roller 72, four transfer rollers 74, and a cleaning portion 75. The photosensitive drums 52 are in contact with the outer surface of the conveying belt 73. The transfer rollers 74 provided on the inside of the conveying belt 73 and the respective photosensitive drums 52 in combination hold the conveying belt 73 therebetween.

The cleaning portion 75 is provided below the conveying belt 73 and basically includes a cleaning roller, a pickup roller, a scraping blade, and a toner-storing portion (all shown without the reference numerals). Residual toner, paper lint, and the like adhered to the conveying belt 73 are removed by the cleaning roller, are picked up by the pickup roller, are scraped off by the scraping roller, and are stored in the toner-storing portion.

The fixing unit 80 is provided on the rear side with respect to the photosensitive member units 50 and basically includes a heating roller 81 and a pressing roller 82 pressed against the heating roller 81.

In the image-forming section 30, the surfaces of the photosensitive drums 52 are evenly charged by the respective chargers 53, and the charged surfaces are exposed to the light from the respective LED units 40, whereby electrostatic latent images based on image data are formed on the respective photosensitive drums 52. Meanwhile, toners in the toner-containing portions 65 are supplied to the respective developing rollers 62 by the respective supply rollers 63 and are introduced into portions between the developing rollers 62 and the respective thickness-regulating blades 64, thereby being evened out into thin layers having specific thicknesses on the developing rollers 62.

The toners on the developing rollers 62 are supplied to the respective photosensitive drums 52 having the electrostatic latent images, whereby the electrostatic latent images are visualized, that is, toner images are formed on the photosensitive drums 52. Subsequently, while a sheet S fed from the sheet-feeding section 20 is conveyed through the nips between the conveying belt 73 (transfer rollers 74) and the photosensitive drums 52, the toner images on the photosensitive drums 52 are sequentially transferred to the sheet S in such a manner as to be superposed one on top of another. The sheet S having the superposed toner images is conveyed through the nip between the heating roller 81 and the pressing roller 82, whereby the superposed toner images are thermally fixed.

The sheet-discharging section 90 basically includes a sheet-discharging path 91 and a plurality of conveying rollers 92 that convey the sheet S. The sheet-discharging path 91 extends upward from the exit of the fixing unit 80 and makes a turn toward the front. The sheet S having the thermally fixed superposed toner images is conveyed by the conveying rollers 92 along the sheet-discharging path 91 and is discharged to the outside of the main-body casing 10 onto the discharge tray 13.

Features specific to the present invention will now be described. Specifically, details of each of the developing units 60 and mechanisms of mounting/demounting and moving the developing unit 60 will be described.

[Details of Developing Unit]

Figure 2:
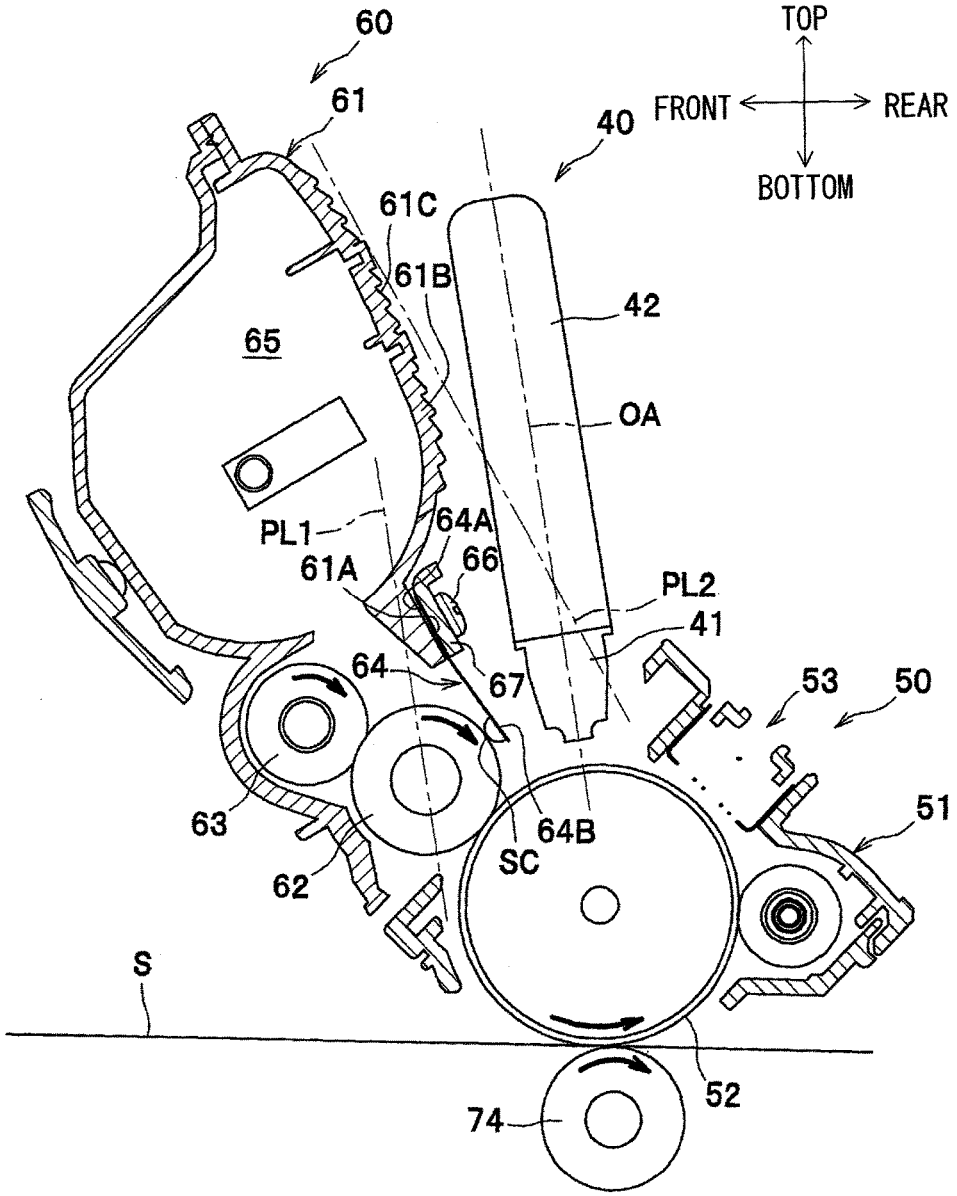
FIG. 2 is an enlarged view of an LED unit, a photosensitive member unit, and a developing unit.

Referring to FIG. 2, the developing unit 60 basically includes the casing 61, the developing roller 62, the supply roller 63, the thickness-regulating blade 64, the toner-containing portion 65, and a fastening member 66. The following description is based on a state where the developing unit 60 is mounted in the main-body casing 10.

The casing 61 supports the developing roller 62, the supply roller 63, the thickness-regulating blade 64, and other relevant components and forms the toner-containing portion 65. When seen in the lateral direction, the wall (rear wall) of the casing 61 near an optical axis OA of exposure light to which a corresponding photosensitive drum 52 is exposed includes a securing surface 61A to which the thickness-regulating blade 64 is secured and a containing-portion wall 61B that forms a wall of the toner-containing portion 65. The containing-portion wall 61B projects outward with respect to the securing surface 61A.

Herein, the "corresponding photosensitive drum 52" refers to one of the photosensitive drums 52 to which the developing roller 62 of the developing unit 60 concerned supplies the toner in the state where the developing unit 60 is mounted in the main-body casing 10. In the case where the line of light emitters of each LED unit 40 that emit exposure light is staggered or in the case where two or more lines of light emitters are arranged in the anteroposterior direction, there are a plurality of optical axes when seen in the lateral direction. In such a case, one of the optical axes that is nearest to the developing unit 60 (the frontmost optical axis) is taken as the optical axis OA.

The developing roller 62 is a publicly known roller configured to supply the toner to the photosensitive drum 52 and is provided on the front upper side of the corresponding photosensitive drum 52. The supply roller 63 is also a publicly known roller configured to supply the toner to the developing roller 62 and is provided on the front upper side of the developing roller 62.

The thickness-regulating blade 64 is a substantially rectangular thin metal plate and includes a base end 64A (the upper end) and a free end 64B (the lower end). The base end 64A is secured to the securing surface 61A of the casing 61. A rubber pressing member (shown without the reference numeral) is provided at the free end 64B and slidingly contacts with the developing roller 62, whereby the thickness of the toner layer is regulated. In the present invention, the thickness-regulating blade may be provided without the rubber pressing member. For example, the tip of the free end of the thickness-regulating blade may be bent substantially perpendicularly in the direction away from the developing roller 62, and the corner of the bent portion may be directly brought into slide contact with the developing roller 62.

When seen in the lateral, direction, the thickness-regulating blade 64 is positioned between the optical axis OA of the exposure light to which the corresponding photosensitive drum 52 is exposed and the developing roller 62 (more specifically, a plane PL1 parallel to the optical axis OA and passing through the center axis of the developing roller 62). The thickness-regulating blade 64 extends such that the direction from the base end 64A to the free end 64B corresponds to a direction (indicated by one of the arrows) of movement of the peripheral surface of the developing roller 62 at a slide-contact portion SC defined between the free end 64B and the developing roller 62. That is, the thickness-regulating blade 64 extends along the securing surface 61A toward the center axis of the photosensitive drum 52. Thus, the thickness-regulating blade 64 is oriented not in the anteroposterior direction (the direction in which the photosensitive drums 52 are arranged) but obliquely with respect to the anteroposterior direction. The thickness-regulating blade 64 is disposed to face the LED unit 40. The base end 64A is disposed between the supply roller 63 and the LED unit 40, and the free end 64B is disposed between the developing roller 62 and the LED unit 40. An angle between a line connecting a center of the developing roller 62 with a center of the photosensitive drum 52 and the optical axis OA may be 12-50 degrees. Specifically, by orienting the thickness-regulating blades 64 obliquely, the angle of 12-20 degrees can be achieved. Thus, a space between the developing units 60 is reduced, and the size of the color LED printer 1 in the direction in which the photosensitive drums 52 are arranged is also reduced.

The toner-containing portion 65 is formed of a portion of the casing 61 and contains a toner (not shown). As described above, the rear wall (containing-portion wall 61B) of the toner-containing portion 65 projects toward the outside of the developing unit 60, i.e., bulges out, with respect to the securing surface 61A.

The fastening member 66 fastens the thickness-regulating blade 64 and a blade-reinforcing plate 67 to the securing surface 61A (casing 61) such that the base end 64A of the thickness-regulating blade 64 is held between the blade-reinforcing plate 67 and the securing surface 61A. The fastening member 66 may be any member such as a screw or a rivet. As another alternative, a projection may be provided on the securing surface 61A. In that case, a through-hole is provided in the thickness-regulating blade 64; the projection is made to project from the through-hole; and the head of the projection is melted, whereby the thickness-regulating blade 64 is fastened to the securing surface 61A.

In the embodiment, the thickness-regulating blade 64, the blade-reinforcing plate 67, and the fastening member 66 are provided on the inner side of a plane PL2 that is parallel to the securing surface 61A and is tangent to an outer surface 61C of the containing-portion wall 61B. In other words, the thickness-regulating blade 64, the blade-reinforcing plate 67, and the fastening member 66 are provided so as not to project toward the rear with respect to the plane PL2. Thus, the developing unit 60 has a reduced size.

According to the embodiment, the thickness-regulating blade 64 provided between the developing roller 62 and the optical axis OA when seen in the lateral direction extends from the base end 64A to the free end 64B in the direction corresponding to, not opposite to, the direction of movement of the peripheral surface of the developing roller 62 at the slide-contact portion SC. Such a configuration allows the thickness-regulating blade 64 to be oriented obliquely with respect to the anteroposterior direction. Hence, compared with the known configuration in which the thickness-regulating blade extends substantially in the anteroposterior direction, the developing unit 60 has a reduced length (thickness) in the anteroposterior direction. Consequently, the size of the color LED printer 1 in which such developing units 60 are arranged in the anteroposterior direction is further reduced.

In the embodiment, the thickness-regulating blade 64 and the fastening member 66 are provided so as not to project toward the rear with respect to the plane PL2. This allows the tip (head 41) of the LED unit 40 to be placed in a space defined by the containing-portion wall 61B, the thickness-regulating blade 64, and the photosensitive drum 52. In other words, the LED unit 40 can be oriented obliquely with respect to the thickness-regulating blade 64 (securing surface 61A) such that the tip thereof is positioned near the thickness-regulating blade 64. Such an arrangement reduces the space in the main-body casing 10 occupied by each set of the LED unit 40 and the developing unit 60. Consequently, the size of the color LED printer 1 is further reduced.

[Mechanism of Mounting/Demounting Developing Unit]

Figure 3:
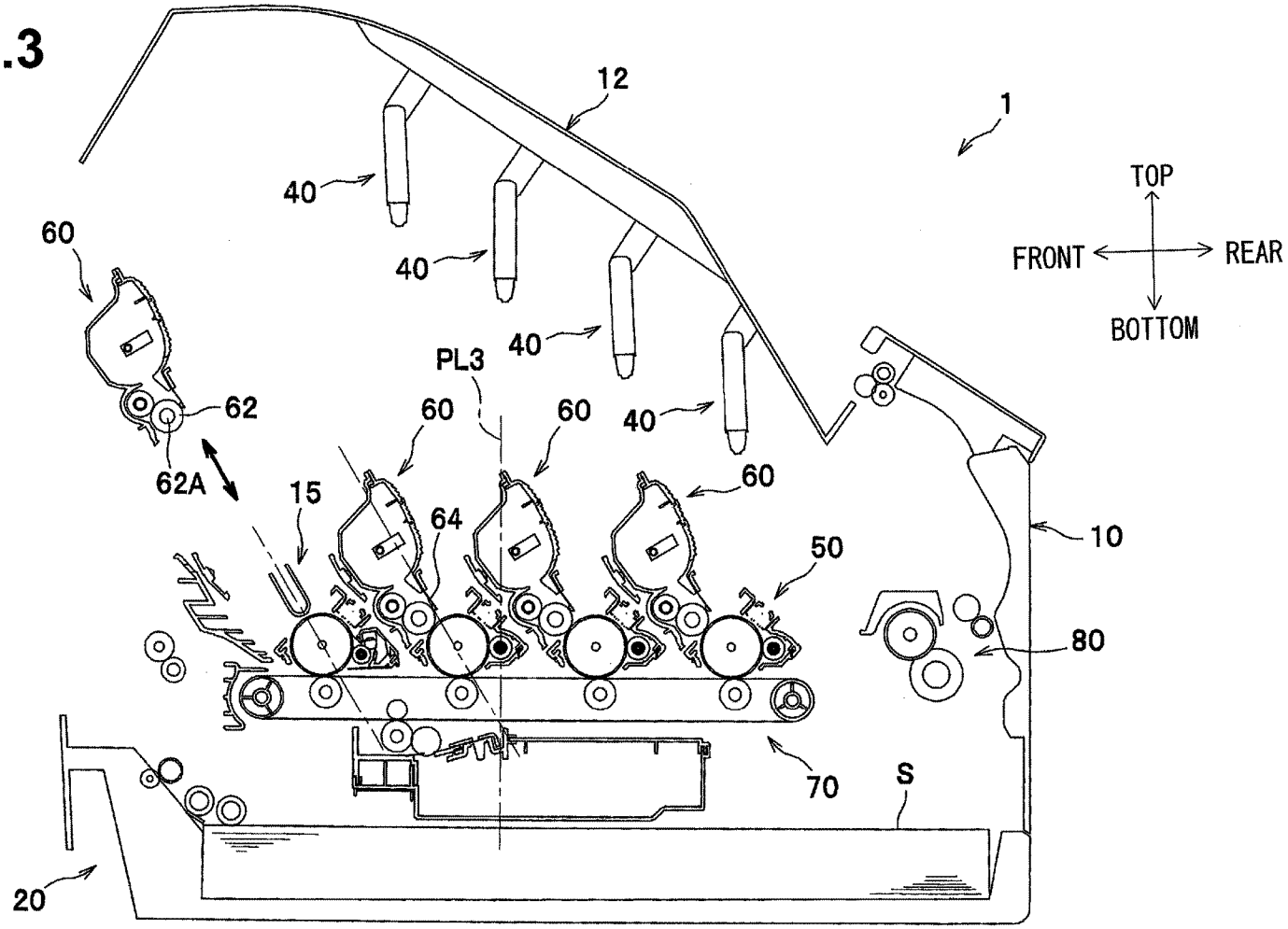
FIG. 3 shows how each of developing units is mounted or demounted.

Referring to FIG. 3, the developing unit 60 is supported by the main-body casing 10 in such a manner as to be demountable therefrom and mountable thereinto in the state where the upper cover 12 is opened. Specifically, the main-body casing 10 has in the inner surfaces of the right and left sidewalls thereof a total of four pairs of guiding grooves 15 (one of the guiding grooves 15 is shown in FIG. 3) for the four respective developing units 60. Each of the developing units 60 is mountable into and demountable from the main-body casing 10 by moving a rotational shaft 62A of the developing roller 62 along a corresponding pair of guiding grooves 15.

When seen in the lateral direction, the guiding grooves 15 each have a substantially U shape with the upper front end thereof open and the lower rear end thereof closed, extending in a direction (represented by the alternate long and short dashed line) in which the thickness-regulating blade 64 of the developing unit 60 mounted in the main-body casing 10 extends.

Hereinafter, the "direction in which the thickness-regulating blade 64 extends" refers to the direction in which the thickness-regulating blade 64 extends from the base end 64A to the free end 64B thereof. The free end 64B of the thickness-regulating blade 64 is slightly warped toward the rear because of the presence of the pressing member that slidingly contacts with the developing roller 62. Therefore, the thickness-regulating blade 64 is not planar (not straight when seen in the lateral direction). Hence, the "direction in which the thickness-regulating blade 64 extends" is represented in the drawings as the direction in which the securing surface 61A extends when seen in the lateral direction.

By mounting the developing unit 60 into the guiding grooves 15 (main-body casing 10), the direction in which the thickness-regulating blade 64 (securing surface 61A) extends is tilted toward the front with respect to a plane PL3 that is orthogonal to the anteroposterior direction (the direction in which the developing units 60 are arranged). Furthermore, the developing unit 60 is supported in such a manner as to be mountable into and demountable from the main-body casing 10 obliquely with respect to the plane PL3, i.e., in the direction in which the thickness-regulating blade 64 (securing surface 61A) extends, by being moved along the guiding grooves 15.

The color LED printer 1 having such a configuration has a reduced length in the anteroposterior direction, and the developing units 60 are mountable and demountable more easily than in a configuration where the developing units are mounted and demounted in the vertical direction. Particularly, the developing units 60 according to the embodiment are tilted toward the front with respect to the plane PL3, allowing the developing units 60 to be mounted and demounted from the front side. Therefore, the developing units 60 are mountable and demountable more easily.

[Mechanism of Moving Developing Units]

The color LED printer 1 further includes a developing-unit-moving mechanism configured to move the four developing units 60 between adjacent positions (see FIGS. 4A and 4B), at which the developing rollers 62 are near the corresponding photosensitive drums 52, and distant positions (see FIGS. 5A and 5B), at which the developing rollers 62 are away from the corresponding photosensitive drums 52 relative to when the developing rollers 62 are at the adjacent positions.

The adjacent positions may be either positions at which the developing rollers 62 and the photosensitive drums 52 are in contact or not in contact with each other, as long as the toners can be supplied from the developing rollers 62 to the photosensitive drums 52.

The developing-unit-moving mechanism according to the embodiment is configured to move the developing units 60 in the direction in which the thickness-regulating blades 64 (securing surfaces 61A) extend. An exemplary developing-unit-moving mechanism 16 shown in FIGS. 4A and 5A is configured to move the developing units 60 along the guiding grooves 15 and mainly includes operation bars 17 and a driving-force-inputting portion (not shown) from which a driving force is input to the operation bars 17.

The operation bars 17 are provided on the inner surfaces of the right and left sidewalls, respectively, of the main-body casing 10 and are supported in such a manner as to be movable in the anteroposterior direction relative to the main-body casing 10. The operation bars 17 each have at the top thereof four recesses 17A engageable with the rotational shafts 62A of the respective developing rollers 62 and four sloping surfaces 17B continued from the rear of the bottoms of the respective recesses 17A and sloping from the front side toward the rear side to the top surface of the operation bar 17. The operation bars 17 have at the rear bottoms thereof racks 17C, respectively. Transmission gears 18 included in the driving-force-inputting portion mesh with the racks 17C, respectively.

The driving-force-inputting portion is a mechanism that transmits a driving force for moving the operation bars 17 in the anteroposterior direction to the operation bars 17, and is configured to transmit the driving force generated by a motor (not shown) provided in the main-body casing 10 to the transmission gears 18 through the intermediary of other gears or the like (not shown).

Figure 4A:
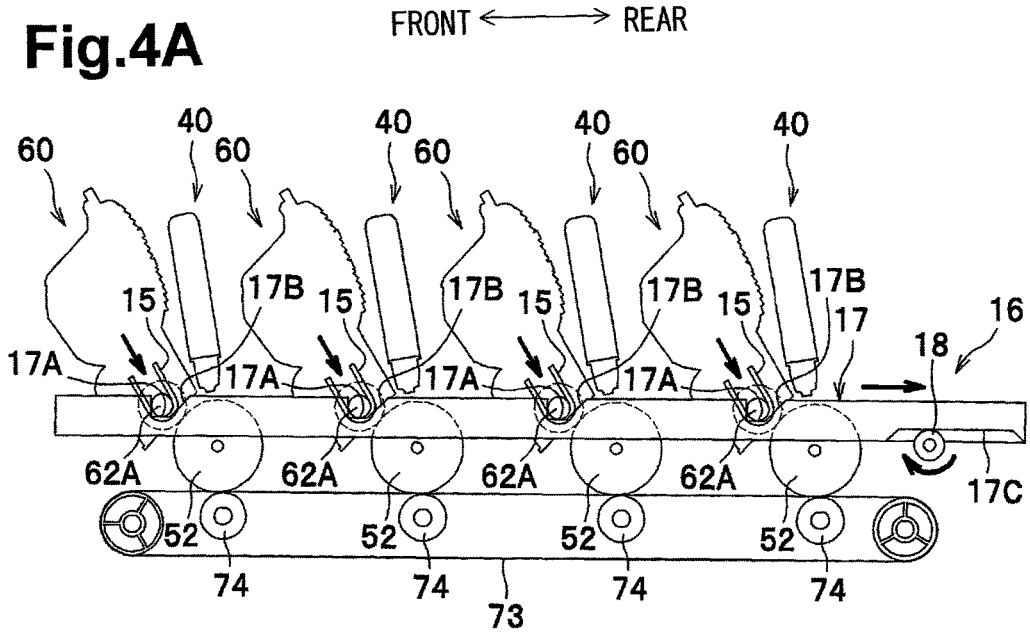
FIGS. 4A and 4B show a state where the developing units are at adjacent positions.
Figure 4B:
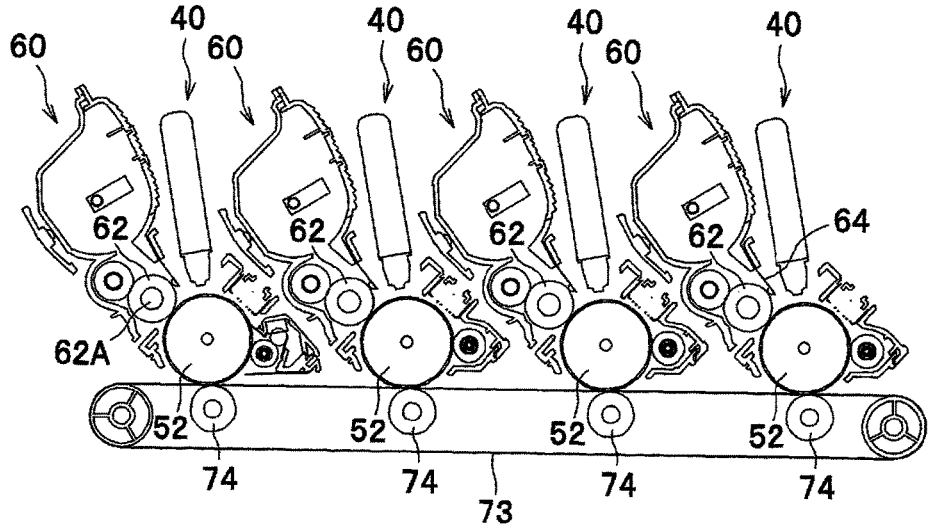
Figure 5A:
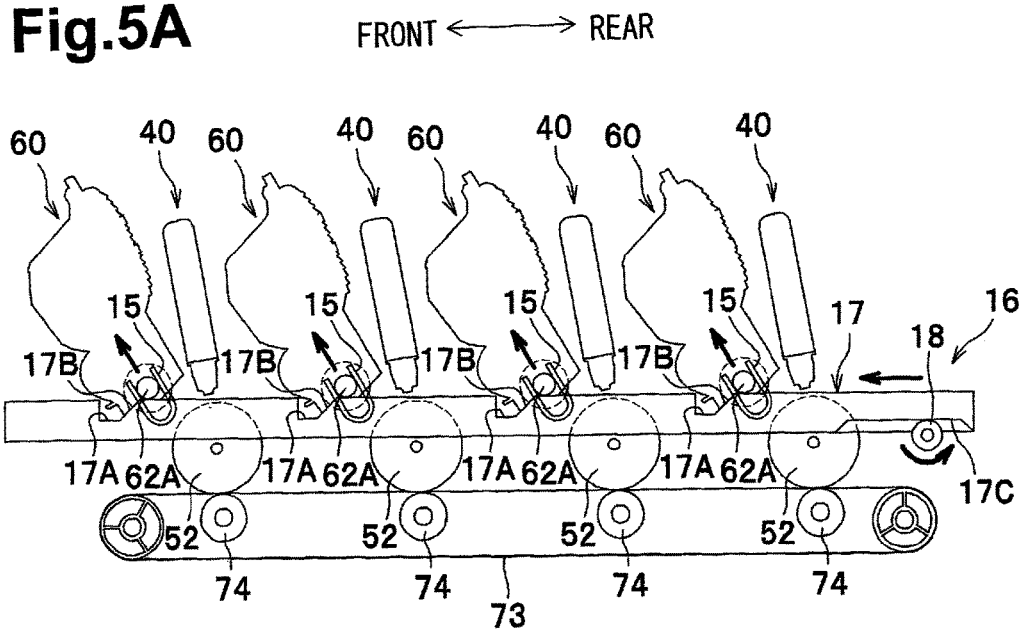
FIGS. 5A and 5B show a state where the developing units are at distant positions.
Figure 5B:
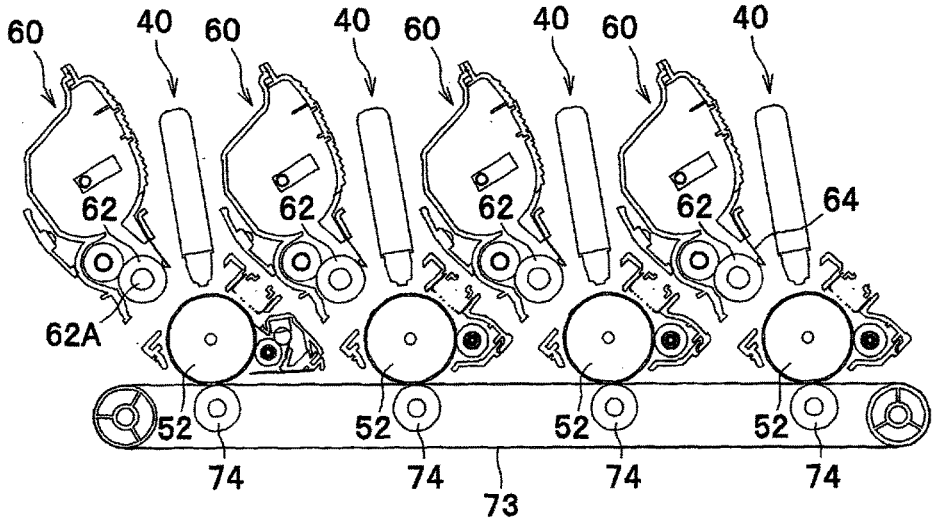

In the state where the developing units 60 are at the adjacent positions as shown in FIGS. 4A and 4B so that, for example, image formation is performed, the rotational shafts 62A of the developing rollers 62 are in the recesses 17A of the operation bars 17. In other situations such as when image formation is stopped (the printer 1 goes to stand by) and when the conveying belt 73 is to be cleaned by the cleaning portion 75, the developing-unit-moving mechanism 16 moves the developing units 60 to the distant positions.

Specifically, as shown in FIG. 5A, the developing-unit-moving mechanism 16 causes the transmission gears 18 to rotate counterclockwise, thereby moving the operation bars 17 toward the front. Accordingly, the sloping surfaces 17B push up the rotational shafts 62A, and the developing units 60 move obliquely upward along the guiding grooves 15 from the adjacent positions to the distant positions.

To move the developing units 60 from the distant positions to the adjacent positions, referring now to FIG. 4A, the developing-unit-moving mechanism 16 causes the transmission gears 18 to rotate clockwise, thereby moving the operation bars 17 toward the rear. Accordingly, the rotational shafts 62A engage with the recesses 17A, and the developing units 60 move obliquely downward along the guiding grooves 15 from the distant positions to the adjacent positions.

In the embodiment, the developing units 60 are moved between the adjacent positions and the distant positions in the direction in which the thickness-regulating blades 64, which are obliquely oriented, extend. Therefore, the space provided for moving the developing units 60 has a reduced length in the anteroposterior direction. Consequently, the size of the color LED printer 1 in the anteroposterior direction is reduced. Particularly, since the developing units 60 according to the embodiment are moved between the adjacent positions and the distant positions along the guiding grooves 15 provided for the mounting/demounting thereof, the configuration of the color LED printer 1 is simpler than a configuration in which a mechanism of mounting/demounting the developing units is provided separately from a mechanism of moving the developing units.

In the embodiment of the present invention, it is important that the developing units 60 are moved between the adjacent positions and the distant positions in the direction in which the thickness-regulating blades 64 extend. Therefore, the configuration of the developing-unit-moving mechanism is not particularly limited, as long as the foregoing movement of the developing units 60 is realized. That is, any publicly known configuration may be employed as the mechanism of moving the developing units 60. Specifically, the developing units 60 may be moved with cams or by being pulled up.

While an embodiment of the present invention has been described above, the present invention is not limited thereto, and details thereof may be suitably changed without departing from the spirit of the present invention.

The above embodiment concerns a case where all of the developing units 60 are moved between the adjacent positions and the distant positions by the developing-unit-moving mechanism 16. The present invention is not limited to such a configuration. For example, in a case where a monochrome image is to be formed, the developing units 60 other than the one containing the black toner may be moved from the adjacent positions to the distant positions. That is, it is sufficient that the developing-unit-moving mechanism is configured to move at least one of a plurality of developing units between the adjacent position and the distant position.

Figure 6:
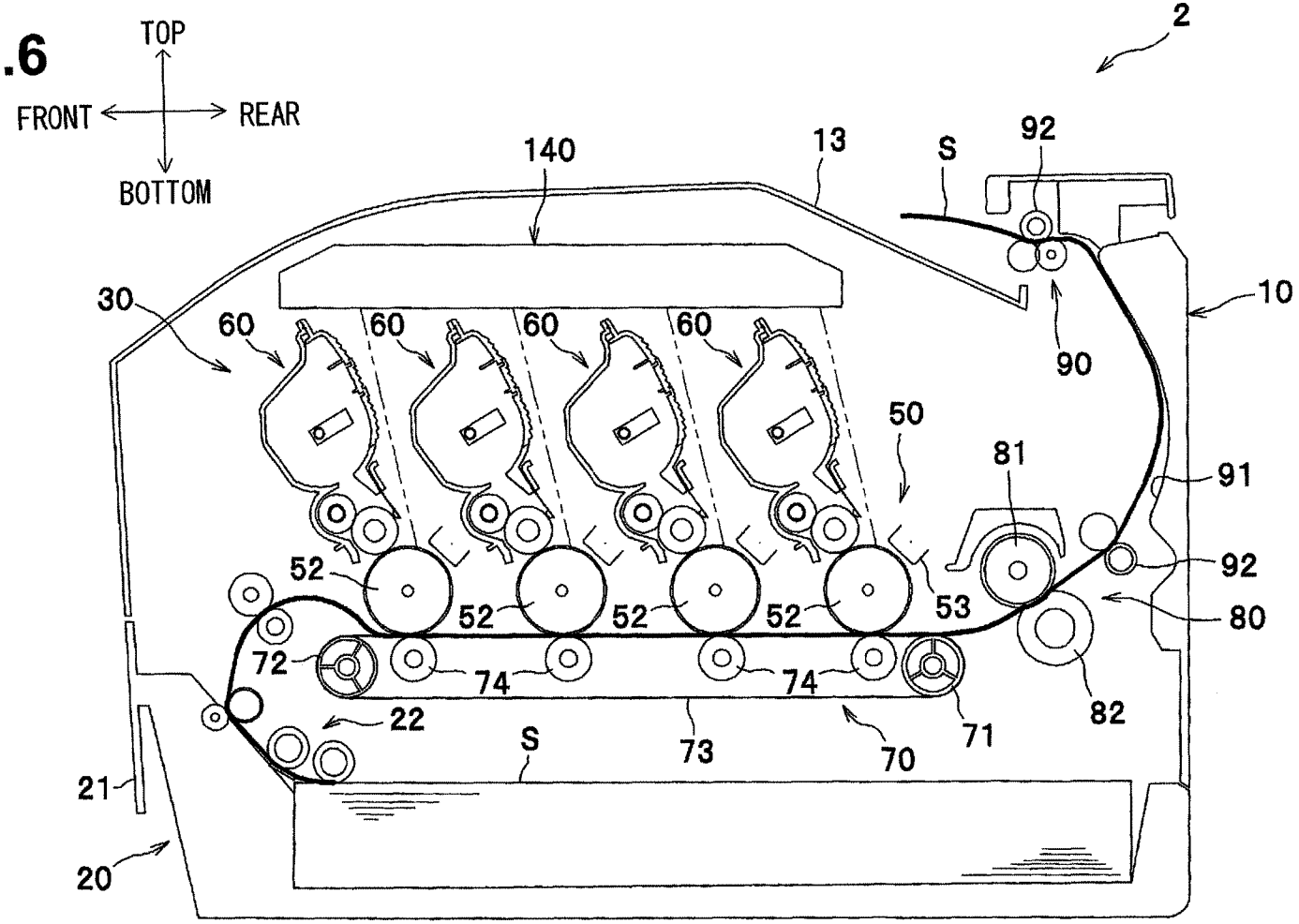
FIG. 6 shows the overall configuration of a color laser printer as an exemplary image-forming apparatus according to a variation of the embodiment.

The above embodiment concerns a case where a plurality of exposure units (LED units 40) are provided. The present invention is not limited to such a configuration. For example, as in a color laser printer 2 shown in FIG. 6, only one exposure unit (laser unit 140) may be provided. The laser unit 140 shown in FIG. 6 is provided at the top in the main-body casing 10 (above the developing units 60) and basically includes a laser light source, a polygonal mirror, a plurality of lenses, and a plurality of reflective mirrors (all not shown). While laser light emitted from the laser light source in accordance with image data is reflected by the polygonal mirror and the reflective mirrors and is transmitted through the lenses, the charged surfaces of the photosensitive drums 52 are exposed to the laser light that is scanningly moved therealong at a high speed. Such a configuration contributes to reducing the intervals between the developing units 60 and consequently to further reducing the size of the apparatus.

The above embodiment concerns a case where each thickness-regulating blade 64 is fastened to the casing 61 with the fastening member 66 while being held between the securing surface 61A and the blade-reinforcing plate 67. The present invention is not limited to such a configuration. For example, the thickness-regulating blade 64 may be fastened to the casing 61 without the blade-reinforcing plate 67. If the blade-reinforcing plate 67 is interposed, the force applied from the fastening member 66, such as a screw, to the thickness-regulating blade 64 is substantially evened out in the longitudinal direction of the thickness-regulating blade 64, which is a thin metal plate. Therefore, deformation of the thickness-regulating blade 64 is suppressed. Consequently, the toner layer on the developing roller 62 is regulated to have a substantially even thickness.

The above embodiment concerns a case where the base end 64A of the thickness-regulating blade 64 is directly secured to the casing 61 (securing surface 61A). The present invention is not limited to such a configuration. For example, the base end 64A of the thickness-regulating blade 64 may be secured to the casing 61 with another member, such as a metal sheet, interposed therebetween.

The above embodiment concerns a case where each developing unit 60 is mounted such that the direction in which the thickness-regulating blade 64 extends is tilted toward the front with respect to the plane PL3. The present invention is not limited to such a configuration. For example, the direction in which the thickness-regulating blade 64 extends may be tilted toward the rear. Moreover, the developing unit 60 may be mounted such that the thickness-regulating blade 64 extends in the vertical direction.

The above embodiment concerns a case where the developing-unit-moving mechanism 16 configured to move the developing units 60 between the adjacent positions and the distant positions is provided. The present invention is not limited to such a configuration. For example, the developing units 60 that are mounted in the body of the apparatus may be fixed in the body of the apparatus.

The above embodiment concerns a case where the developing units 60 are directly mountable into and demountable from the main-body casing 10 when the upper cover 12 is opened. The present invention is not limited to such a configuration. For example, in the configuration shown in FIG. 6, a box- or frame-like supporting member that can be drawn out of the main-body casing 10 may be provided, and the developing units 60 may be demountably mounted on the supporting member. In such a configuration, the supporting member is first drawn out of the main-body casing 10, and the developing units 60 are then mounted onto or demounted from the supporting member.

The above embodiment concerns a case where the developing units 60 are mountable into and demountable from the main-body casing 10. The present invention is not limited to such a configuration. For example, the developing units 60 may be fixed to (not demountable from) the body of the apparatus. Alternatively, only the developer-containing portions may be demountably provided as developer cartridges.

The configuration of the developing units 60 described in the above embodiment is only exemplary and is not limited thereto. For example, each of the developing units may be provided as an integral (inseparable) body including the photosensitive member unit 50 and the developing unit 60 according to the above embodiment.

The above embodiment concerns a printer (the color LED printer 1 or the color laser printer 2) as an exemplary image-forming apparatus. The image-forming apparatus is not limited to the printer, and may be, for example, a copier or a multifunction machine.

The above embodiment concerns the configuration having four developing units. The number of the developing units is not limited thereto, and the present invention can be realized with at least two developing units.

What is claimed is:

1. An image-forming apparatus comprising:

a first photosensitive member;

a second photosensitive member disposed adjacent the first photosensitive member;

a plurality of exposure units comprising a first LED unit configured to expose the first photosensitive member to light and a second LED unit configured to expose the second photosensitive member to light, wherein the plurality of exposure units are swingable;

a top cover to which each of the first LED unit and the second LED unit are separately attached, the top cover being pivotable between a closed position and an open position, such that:

the first LED unit is moved between a first exposing position where the first LED unit is close to the first photosensitive member and a first removed position where the first LED unit is away from the first photosensitive member; and the second LED unit is moved between a second exposing position where the second LED unit is close to the second photosensitive member and a second removed position where the second LED unit is away from the second photosensitive member;

a first developing unit comprising:

a first developing roller configured to supply developer to the first photosensitive member;

a first casing configured to support the first developing roller; and a first thickness-regulating blade having a first base end and a first free end, the first base end being secured to the first casing along a first securing surface, the first free end regulating the thickness of the developer supplied to the first photosensitive member by slidingly contacting with the first developing roller, wherein the first thickness-regulating blade has a first surface directly facing the first LED unit in the first exposing position and the first LED unit is movable from the first exposing position toward the first removed position along the first surface of the first thickness-regulating blade; and a second developing unit comprising:

a second developing roller configured to supply developer to the second photosensitive member;

a second casing configured to support the second developing roller; and a second thickness-regulating blade having a second base end and a second free end, the second base end being secured to the second casing, the second free end regulating the thickness of the developer supplied to the second photosensitive member by slidingly contacting with the second developing roller, wherein the first thickness-regulating blade, when seen in an axial direction of the first developing roller, is disposed between the first developing roller and the first LED unit, and the first thickness-regulating blade extends from the first base end to the first free end in a following direction with respect to a moving direction of a peripheral surface of the first developing roller, wherein the first free end of the first thickness-regulating blade extends from the first securing surface toward a center axis of rotation of the first photosensitive member.

2. The image-forming apparatus according to claim 1, wherein the second thickness-regulating blade, when seen in an axial direction of the second developing roller, is disposed between the second developing roller and the second LED unit, or between the second developing roller and a second optical axis of the light to which the second photosensitive member is exposed, and the second thickness-regulating blade extends from the second base end to the second free end in a following direction with respect to a moving direction of a peripheral surface of the second developing roller.

3. The image-forming apparatus according to claim 2, further comprising:

a third photosensitive member disposed downstream of the second photosensitive member;

a third LED unit configured to expose the third photosensitive member to light;

a fourth photosensitive member disposed downstream of the third photosensitive member;

a fourth LED unit configured to expose the fourth photosensitive member to light;

a third developing unit comprising:

a third developing roller configured to supply developer to the third photosensitive member;

a third casing configured to support the third developing roller; and a third thickness-regulating blade having a third base end and a third free end, the third base end being secured to the third casing, the third free end regulating the thickness of the developer supplied to the third photosensitive member by slidingly contacting with the third developing roller; and a fourth developing unit comprising:

a fourth developing roller configured to supply developer to the fourth photosensitive member;

a fourth casing configured to support the fourth developing roller; and a fourth thickness-regulating blade having a fourth base end and a fourth free end, the fourth base end being secured to the fourth casing, the fourth free end regulating the thickness of the developer supplied to the fourth photosensitive member by slidingly contacting with the fourth developing roller, wherein the third thickness-regulating blade, when seen in an axial direction of the third developing roller, is disposed between the third developing roller and the third LED unit, or between the third developing roller and a third optical axis of the light to which the third photosensitive member is exposed, and the third thickness-regulating blade extends from the third base end to the third free end in a following direction with respect to a moving direction of a peripheral surface of the third developing roller, and wherein the fourth thickness-regulating blade, when seen in an axial direction of the fourth developing roller, is disposed between the fourth developing roller and the fourth LED unit, or between the fourth developing roller and a fourth optical axis of the light to which the fourth photosensitive member is exposed, and the fourth thickness-regulating blade extends from the fourth base end to the fourth free end in a following direction with respect to a moving direction of a peripheral surface of the fourth developing roller.

4. The image-forming apparatus according to claim 1, further comprising a developing-unit-guiding mechanism configured to guide the first developing unit from a distant position, at which the first developing roller is distant from the first photosensitive member, to an adjacent position, at which the first developing roller is adjacent to the first photosensitive member, in the following direction of the first thickness-regulating blade.

5. The image-forming apparatus according to claim 1, wherein the first developing unit is mountable into an apparatus body in the following direction of the first thickness-regulating blade, and the following direction extends obliquely with respect to a plane orthogonal to a direction in which the first developing unit and the second developing unit are arranged.

6. The image-forming apparatus according to claim 1, wherein the first thickness-regulating blade faces the first LED unit.

7. The image-forming apparatus according to claim 1, wherein the first developing unit further comprises a first supply roller configured to supply the developer to the first developing roller, and wherein the first base end is disposed between the first supply roller and the first LED unit, and the first free end is disposed between the first developing roller and the first LED unit.

8. The image-forming apparatus according to claim 1, wherein the first developing unit further comprises a first developer-containing portion configured to contain the developer.

9. The image-forming apparatus according to claim 1, further comprising a first charger, wherein the first developing unit is disposed upstream and the first charger is disposed downstream with respect to the first photosensitive member in a conveying direction of a sheet on which an image is formed.

10. The image-forming apparatus according to claim 1, wherein the first developing unit further comprises a first supply roller configured to supply the developer to the first developing roller, and wherein the first base end is disposed at a position higher than the first supply roller.

11. The image-forming apparatus according to claim 1, wherein at least a portion of the first thickness-regulating blade adjacent to the first LED unit is disposed to face the first LED unit.

12. The image forming apparatus according to claim 1, wherein the first developing unit, which comprises the first thickness-regulating blade, is movable with respect to the first LED unit in the first exposing position and is removable when the first LED unit is in the removed position.

13. The image forming apparatus according to claim 1, wherein the image-forming apparatus further comprises a cam configured to:

when the top cover is in the closed position and the first LED unit is in the first exposing position, separate the first developing unit from the first photosensitive member in a direction along the first LED unit and opposite to the following direction in which the first thickness-regulating blade extends; and when the top cover is in the closed position and the first and second LED units are in the first and second exposing positions, respectively, separate the second developing unit from the second photosensitive member in the direction along the first and second LED units and opposite the following direction in which the second thickness-regulating blade also extends.

14. An image-forming apparatus comprising:

a first photosensitive member;

a second photosensitive member disposed adjacent the first photosensitive member;

a plurality of exposure units comprising a first LED unit configured to expose the first photosensitive member to light and a second LED unit configured to expose the second photosensitive member to light, wherein the plurality of exposure units are swingable;

a top cover to which each of the first LED unit and the second LED unit are separately attached, the top cover being pivotable between a closed position and an open position, such that:

the first LED unit is moved between a first exposing position where the first LED unit is close to the first photosensitive member and a first removed position where the first LED unit is away from the first photosensitive member; and the second LED unit is moved between a second exposing position where the second LED unit is close to the second photosensitive member and a second removed position where the second LED unit is away from the second photosensitive member;

a first developing unit comprising:

a first developing roller configured to supply developer to the first photosensitive member;

a first casing configured to support the first developing roller; and a first thickness-regulating blade having a first base end and a first free end, the first base end being secured to the first casing along a first securing surface, the first free end regulating the thickness of the developer supplied to the first photosensitive member by slidingly contacting with the first developing roller, wherein the first thickness-regulating blade has a first surface directly facing the first LED unit in the first exposing position and the first LED unit is movable from the first exposing position toward the first removed position along the first surface of the first thickness-regulating blade; and a second developing unit comprising:

a second developing roller configured to supply developer to the second photosensitive member;

a second casing configured to support the second developing roller; and a second thickness-regulating blade having a second base end and a second free end, the second base end being secured to the second casing, the second free end regulating the thickness of the developer supplied to the second photosensitive member by slidingly contacting with the second developing roller, wherein the first thickness-regulating blade, when seen in an axial direction of the first developing roller, is disposed between the first developing roller and the first LED unit and the first thickness-regulating blade extends from the first base end to the first free end in a following direction with respect to a moving direction of a peripheral surface of the first developing roller, wherein at least a portion of the first thickness-regulating blade adjacent to the first LED unit is disposed to face the first LED unit, wherein the first free end of the first thickness-regulating blade extends from the first securing surface toward a center axis of rotation of the first photosensitive member.

15. The image forming apparatus according to claim 14, wherein the first developing unit, which comprises the first thickness-regulating blade, is movable with respect to the first LED unit in the first exposing position and is removable when the first LED unit is in the removed position.

16. The image forming apparatus according to claim 14, wherein the image-forming apparatus further comprises a cam configured to:

when the top cover is in the closed position and the first LED unit is in the first exposing position, separate the first developing unit from the first photosensitive member in a direction along the first LED unit and opposite to the following direction in which the first thickness-regulating blade extends; and when the top cover is in the closed position and the first and second LED units are in the first and second exposing positions, respectively, separate the second developing unit from the second photosensitive member in the direction along the first and second LED units and opposite the following direction in which the second thickness-regulating blade also extends.

* * * * *